US006818116B2

(12) United States Patent
Stoffer et al.

(10) Patent No.: US 6,818,116 B2
(45) Date of Patent: Nov. 16, 2004

(54) ADDITIVE-ASSISTED CERIUM-BASED ELECTROLYTIC COATING PROCESS FOR CORROSION PROTECTION OF ALUMINUM ALLOYS

(75) Inventors: James O. Stoffer, Rolla, MO (US); Thomas J. O'Keefe, Rolla, MO (US); Eric L. Morris, Rolla, MO (US); Scott Hayes, Rolla, MO (US); Paul Yu, Rolla, MO (US); Alex Williams, Rolla, MO (US); Xuan Lin, Orange, CT (US)

(73) Assignee: The Curators of the University of Missouri, Columbia, MO (US)

( * ) Notice: Subject to any disclaimer, the term of this patent is extended or adjusted under 35 U.S.C. 154(b) by 37 days.

(21) Appl. No.: 10/214,993

(22) Filed: Aug. 8, 2002

(65) Prior Publication Data

US 2004/0026260 A1 Feb. 12, 2004

(51) Int. Cl.[7] ..... C25D 3/56; C25D 3/00
(52) U.S. Cl. ..... 205/238; 205/261
(58) Field of Search ..... 205/238, 261

(56) References Cited

U.S. PATENT DOCUMENTS

| | | | | |
|---|---|---|---|---|
| 5,587,059 | A | 12/1996 | Yamoto et al. | |
| 5,932,083 | A | 8/1999 | Stoffer et al. | |
| 6,306,276 | B1 * | 10/2001 | Nobe et al. | 205/238 |

FOREIGN PATENT DOCUMENTS

| | | |
|---|---|---|
| JP | 55/065326 A | 5/1980 |
| WO | WO 88/06639 | 9/1988 |
| WO | WO 02/14586 A1 | 2/2002 |

OTHER PUBLICATIONS

Fujita et al., "Fabrication of Co–Ce–O Films By Metal–Oxide Co–Electrodeposition Method From Reaction Solution Including A Complexing Agent", Nippon Oyo Jiki Gakkaishi (no month, 2001), vol. 25, No. 4–2, pp. 883–886.*

Aldykiewicz, Jr., et al., Studies of the Formation of Cerium Rich Protective Films Using X–Ray Absorption Near–Edge Spectroscopy and Rotating Disk Electrode Methods, J. Electrochem, Soc., vol. 143, No. 1, Jan. 1996, pp. 147–153.

Hinton, et al., Cerium Conversion Coatings for the Corrosion Protection of Aluminum, Materials Forum, vol. 9, No. 3, 1986, pp. 162–173, no month.

Hinton, et al., Cerium Oxide Coatings for Corrosion Protection of Aluminum Alloys, Materials Australasia, Jan./Feb., 1987, pp. 18–20.

Aldykewicz, Jr., et al., The Investigation of Cerium as a Cathodic Inhibitor for Aluminum–Copper Alloys, J. Electrochem Soc., vol. 142, No. 10, Oct. 1995, pp. 3342–3350.

Davenport, et al., Xanes Investigation of the Role of Cerium Compounds as Corrosion Inhibitors for Aluminum, Corrosion Science, vol. 32, No. 5/6, pp. 653–663; 1991, no month.

Weiser, The Hydrous Oxides, McGraw–Hill Book Company, Inc., 1926, pp. 253–259, no month.

Hinton, et al., The Inhibition of Aluminum Alloys Corrosion by Cerous Cations, Metals Forum, vol. 7, No. 4, 1984, pp. 211–217, no month.

Mansfeld et al., Corrosion Protection of A1 Alloys and A1 based Metal Matrix, Corrosion 88, Mar. 21–25, 1988 paper 380, NACE.

Davenport et al., X–Ray Absorption Study of Cerium in the Passive Film on Aluminum, J. Electrochem Soc., vol. 136, No. 6, Jun. 1989, pp. 1837–1838.

Hinton, New Approaches to Corrosion Inhibition with Rare Earth Metal Salts, Corrosion 89, Apr. 17–21, 1989, paper 170, NACE.

Hinton, et al., The Corrosion Inhibition of Zinc with Cerous Chloride, Corrosion Science, 29, 1989, pp. 967–984, no month.

Hinton, Corrosion Inhibition with Rare Earth Metal Salts, Journal of Alloys and Compounds, 180, 1992, pp. 15–25, no month.

* cited by examiner

*Primary Examiner*—Edna Wong
(74) *Attorney, Agent, or Firm*—Senniger Powers

(57) ABSTRACT

The corrosion resistance of an aluminum or aluminum alloy component is enhanced by immersing an aluminum alloy to act as a cathode and an oxygen-evolving anode in an electrolyte comprising water, cerium ions, and an additive selected from among animal gelatin, derivatives of animal gelatin, and amino acids, then passing an electrical current through the electrolyte to deposit a cerium-based coating onto the aluminum-based component.

29 Claims, No Drawings

ADDITIVE-ASSISTED CERIUM-BASED ELECTROLYTIC COATING PROCESS FOR CORROSION PROTECTION OF ALUMINUM ALLOYS

This invention was made with government support under grant number AFOSRF49620-96-1-0140 awarded by the United States Air Force. The government has certain rights in the invention.

BACKGROUND OF THE INVENTION

This invention relates to a method for enhancing the corrosion resistance of aluminum and aluminum alloys by deposition of a cerium-based coating thereon. The invention has particular application for aerospace structural components such as aircraft skin, wing skin and other sheet components manufactured from aluminum or aluminum alloys, especially sheet and bulk structural pieces, or in other applications where long-term corrosion resistance is desired.

Many aerospace components are constructed from aluminum or aluminum alloys due to their superior strength to weight ratio.

Aluminum and aluminum alloys, however, are subject to corrosion upon exposure to water condensed from humid air and contaminated from other sources with salt, rain, snow, ocean salt, salt applied to runways, and other environmental conditions, which can lead to catastrophic failure. Heretofore the corrosion resistance of aluminum and aluminum alloys has been enhanced by the use of chromate conversion coatings. A conversion coating is a coating consisting of metallic salts, such as chromate, which form during and after dissolution of a metallic element, such as chromium or aluminum, or are precipitated from salts onto a substrate. A disadvantage of chromate coatings, however, is their toxicity, as ingestion or inhalation of chromates has been determined to cause kidney failure, liver damage, blood disorders, lung cancer and eventually death. Corrosion resistance has also been enhanced by anodizing. However, anodizing is known to cause fatigue problems leading to failure of aluminum components.

Stoffer et al. U.S. Pat. No. 5,932,083 discloses electrodeposition of cerium-based components onto aluminum substrates.

SUMMARY OF THE INVENTION

Among the several objects of this invention, therefore, is the enhancement of the corrosion resistance of aluminum and aluminum alloy aircraft components; the enhancement of corrosion resistance of such components without reducing fatigue resistance; the enhancement of the corrosion resistance of aluminum and aluminum alloys using materials which are not toxic in the relevant concentrations; the enhancement of the corrosion resistance of aluminum and aluminum alloys using a cerium-based coating produced by electrodeposition resulting in spent electrolyte having minimal negative environmental impact.

Briefly, therefore, the invention is directed to a process for enhancing the corrosion resistance of an aluminum-containing component in which an aluminum-containing cathode and an oxygen-evolving anode are immersed in an electrolyte comprising water, cerium ions, and animal gelatin or derivative or components thereof, and an electrical current is passed through the electrolyte to deposit a cerium-based coating onto the aluminum-containing cathode.

Other objects and features of the invention will be in part apparent, and in part described hereafter.

DETAILED DESCRIPTION OF THIS INVENTION

Cerium (Ce) is a malleable, ductile metallic element having an atomic number of 58 and an atomic weight of 140.12. It is the most abundant of the rare earth metallic elements. Cerium possesses highly stable oxides, $CeO_2$ or $Ce_2O_3$, in the oxidation states of 3 and 4. Cerium ions are precipitated to form an oxide adsorbed readily on the surface of $Al(OH)_3$ or $Al_2O_3$ to provide a $CeO_2$ coating which provides extensive corrosion protection. A cerium-based coating is a coating formed by the precipitation of cerium salts onto a substrate. The preferred cerium-based coatings, as deposited, are cerium oxide and hydrated cerium oxide. The cerium-based coating of the invention enhances corrosion resistance by enhanced barrier protection and electrochemical protection.

In one aspect the invention consists of an electrodeposited cerium-based coating formed in conjunction with an electrochemical process on an aluminum or aluminum alloy structural component, which coating is of relatively uniform thickness, is blister-free, and strongly adhered to the component. The coating has a continuous surface area and a thickness of at least about 0.1 microns, preferably from about 0.1 to about 1.0 microns, and more preferably about 0.7 microns. An electrodeposited cerium-based coating significantly thicker than about 1.0 micron, it has been discovered, sometimes suffers from cracking and delamination, unless deposition parameters are modified to counteract brittleness.

In another aspect the invention consists of an aluminum or aluminum alloy structural component having the cerium-based coating described above. Examples of such structural components include aircraft components including the skin of an aircraft fuselage and wing, panels, clamps, brackets and other components. Other coated components, include, more generally, structural components (not limited to aircraft components) comprising aluminum or alloys comprising at least about 85% aluminum by weight such as, for example, 2000, 3000, 6000 and 7000 series aluminum alloys generally, alloys 7075 aluminum, 2024 aluminum, 3003 aluminum specifically.

In accordance with the process of the invention, an aluminum-containing component is pretreated by cleaning and/or deoxidizing, thereafter immersed in a cerium-containing solution to deposit a cerium coating thereon with application of an external source of electrons, and finally subjected to a sealing operation.

The pretreatment cleaning operation consists of rinsing the component with an organic solvent such as acetone followed by immersion in a cleaning solution of an alkaline cleaner in water. In one preferred application, the alkaline cleaner is Turco 4215 alkaline cleaner distributed under the trade name Turco NCLT available from Henkel Surface Technologies, Madison Heights, Mich., Ohio, in a concentration of 5% by weight in water. In one preferred embodiment, the component is immersed in this cleaning solution at between about 15° C. and about 65° C. for 5 to 15 minutes, and is then rinsed with distilled water. In another preferred embodiment, the component is immersed in this solution at between about 25° C. and about 60° C. for about 5 to about 10 minutes. The component is then optionally rinsed with tap water followed by deionized water.

In another embodiment the pretreatment deoxidation and activation operation additionally comprises an optional process involving immersion in a solution comprising 5% to 15% by volume nitric or sulfuric acid and about 2.5 wt %

Amchem #7, available from Amchem Products, Inc., a subsidiary of Henkel Surface Technologies of Madison Heights, Mich., at ambient temperature for between about 5 and 15 minutes. In each instance, the substrate is subsequently rinsed, preferably with deionized water.

In accordance with the process of the invention, an electrolytic solution containing cerium is obtained by dissolving a cerium-containing compound in solution. In general, the cerium-containing compound is a cerium salt. A preferred electrolyte has an initial cerium ion concentration at the beginning of electrodeposition which is at least about 0.01 mole per liter cerium ions, with one preferred embodiment containing 0.03 mole per liter. The upper limit of the cerium ion concentration is preferably no more than about 1 mole per liter cerium ions, more preferably no more that about 0.3 mole per liter. In one embodiment the upper limit is no more than about 0.05 mole per liter cerium ions.

A preferred electrolyte is obtained by dissolving cerium nitrate [$Ce(NO3)_3$ * $6H_2O$] in deionized water and adjusting the pH to slightly under 3 with concentrated nitric acid. The solution may or may not contain alcohol, glycol, glycerol or polyhydroxyl as required to obtain the desired morphology.

Hydrogen peroxide or another suitable depolarizing agent such as ozone, nitric acid, hypochlorate or the like is added to the electrolyte as an oxidizing agent to facilitate formation of cerium oxide during deposition. The hydrogen peroxide is preferred to be added to the solution after the introduction of the cerium salt, animal gelatin and nitric acid. The preferred hydrogen peroxide composition is between about 0% and about 10% by volume, more preferably from about 1% to about 8% by volume (approx. 0.09 to 0.71 moles/liter), still more preferably from about 3% to about 6% by volume, most preferably about 4% by volume of the entire electrolyte.

The electrolyte contains gelatin and/or amino acids as an additive to improve coating uniformity and corrosion resistance. Among the gelatin and amino acids which have been discovered to be most effective are pigskin gelatin, proline, hydroxyproline, glycine, and argenine. Among the amino acids which have been discovered to be less effective are fish gelatin, bovine bone, and alkaline bovine bone. In one preferred embodiment, the amount of gelatin and/or amino acids added is between about 0.1 wt % and about 2.0 wt %, preferably between about 0.1 wt % and about 1.0 wt %, more preferably between about 0.2 wt % and about 0.35 wt %.

One preferred animal gelatin is SKW acid processed pigskin available from SKW BIOSYSTEMS, INC. of 620 Progress Avenue, Waukesha, Wis. 53187-1609 U.S.A. Without being bound to a particular theory, it is thought that the gelatin functions to modify the nucleation and growth sites. Fish gelatins have been discovered to be less effective than certain other gelatins such as the pigskin gelatin.

One preferred bath of about 250 mL is prepared with 3.2 g (7.4 mM) $Ce(NO3)_3$ * $6H_2O$ in 200 mL deionized water, with enough nitric acid to adjust the pH to approximately 2. To that solution is added about 0.75 g animal gelatin having been dissolved in 40 mL deionized water, bringing the pH to slightly above 2. To the overall solution is added about 10 mL of 30% hydrogen peroxide.

The initial bulk pH of the electrolytic bath at the beginning of electrodeposition is preferably between about 1 and about 4.5. It has been discovered that if the local pH at the interface between the cathode and electrolyte is too acidic, the cerium-based compound to be precipitated onto the substrate may remain soluble, and does not precipitate, and in fact may never deposit to an acceptable degree or in an acceptable morphology, depending on the operating conditions. As such, the pH is preferably maintained above at least about 1, and preferably above at least about 1.5. If the local pH is not sufficiently acidic, any deposit which forms has an improper composition and structure. As such, it is critical to maintain the bulk pH at a level which promotes the proper local pH at this interface. The pH is therefore preferably maintained below about 4.5, and more preferably below about 3. In one preferred embodiment where the cerium ion concentration is from about 0.01 to 0.1 moles per liter and where the oxidizing agent is hydrogen peroxide, the preferred pH has been determined to be in the range of from about 2.0 to 2.2.

A pure aluminum or aluminum alloy substrate which is to be the subject of corrosion resistance enhancement is provided as a cathode. The aluminum alloy preferably consists of at least about 85% aluminum by weight. Examples of aluminum alloys suitable for use as substrates include 2000, 3000, 6000 and 7000 series aluminum alloys generally, alloys 7075 aluminum and 2024 aluminum specifically. Without being bound to a particular theory, it appears that the cerium-based coating precipitates onto the aluminum substrate. The substrate is optionally treated, for example, by cleaning and deoxidation to promote good adhesion of the conversion coating.

An anode is provided to supply a counter electrode in the electrolytic bath. An anode material is selected which is oxygen-evolving, stable, does not passivate, and does not dissolve in an electrolytic bath of water, solvent, hydrogen peroxide, and cerium salts, and does not otherwise adversely affect the electrolyte. Examples of suitable electrodes are platinum foil, stainless steel, lead dioxide or a dimensionally stable anode (DSA) material, for example, ruthenium oxide or other platinum group metal oxide powder fused to a titanium or stainless steel substrate.

The cathode and anode are immersed in the electrolytic bath and continuous current is passed through the solution between the electrodes resulting in the electrolytic cathodic precipitation of a cerium-based coating onto the aluminum or aluminum alloy cathode surface. Hydrogen is generated at the cathode by the reaction:

$$2H^+ + 2e^- \text{--->} H_2$$

Followed by other reactions at the cathode, such as:

$$4Ce^{3+} + O_2 + 2H_2O + 4OH^- \text{--->} 4Ce(OH)_2^{2+}$$

$$Ce(OH)_2^{2+} + 2OH^- \text{--->} CeO_2 + 2H_2O$$

$$2Ce^{3+} + H_2O_2 + 2H_2O \text{--->} 2\ Ce(OH)_2^{2+} + 2H^+$$

It is believed that the oxidation state of the cerium deposited is +4 and possibly +3 for a portion of the cerium.

During deposition, the current density is preferably maintained at a level above at least about 1 mAmps/$cm^2$, more preferably above at least about 5 mAmps/$cm^2$, still more preferably above at least about 8 mAmps/$cm^2$. The current density is preferably maintained below about 50 mAmps/$cm^2$, more preferably below about 15 mAmps/$cm^2$, still more preferably below about 12 mAmps/$cm^2$. In one embodiment it is about 10 mAmps/$cm^2$. It has been discovered that application of greater current density results in improper composition, and application of too low a current density results in no coating.

To achieve the desired operating current density, the starting current density in some applications, especially where brush plating as described below is used, must be somewhat higher. In particular, the starting current density in certain embodiments is preferably in the range of from about 16 mAmps/cm$^2$ to about 480 mAmps/cm$^2$, more preferably from about 48 to 320 mAmps/cm$^2$, still more preferably about 80 to 160 mAmps/cm$^2$, most preferably about 80 mAmps/cm$^2$. As the coating is deposited the current density decreases; e.g., a starting value of 80 mAmps/cm$^2$ may fall in 30 seconds to about 16 mAmps/cm$^2$ in some process applications.

A constant voltage is applied between the electrodes resulting in the cathodic precipitation of a cerium-based coating onto the aluminum or aluminum alloy cathode surface. The preferred deposition voltage is about 5 to 30 volts, most preferably from about 10 to 25 volts, and a continuous coating having a thickness of about 0.1 to 2.0 microns is generally deposited. The coating could also be made at a constant current density allowing the voltage to increase with deposition time.

The preferred deposition time is about 1 to 10 minutes, more preferably about 1 to 3 minutes, most preferably from about 60 to 90 seconds, until a coating of the desired thickness is attained. As the coating is deposited, the voltage increases as the substrate becomes insulated by the coating. As a guide, it is noted that deposition proceeds relatively unencumbered at about 10 to 50 volts, and that a continuous coating having a thickness of about 0.1 to 1.0 microns is generally deposited by the time the voltage reaches about 30 volts.

The temperature of the electrolytic bath is maintained in the range of from about 0° C. to about 40° C. Too high of a temperature has been discovered to result in a poorly deposited film. The evolution of hydrogen provides sufficient agitation to facilitate diffusion of ions to the interface between the electrode and electrolyte, such that agitation can be used but is not necessary in many instances.

There is very little spent electrolyte generated during the processing and so the waste is limited and can be disposed of by conventional means. Spent electrolyte is recycled and replenished, or is disposed of by conventional, non-hazardous waste water treatment.

After the desired thickness of cerium-based coating is deposited, the supply of current is discontinued and the cathode substrate is removed from the electrolyte. Deposition is usually carried out on a batch or continuous basis.

After deposition the component is optionally sealed by immersion in or otherwise exposure to an elevated temperature phosphate solution, for example 2.5 wt % $Na_3PO_4$ with a pH adjusted to about 4.5 with $H_3PO_4$ for about five minutes. In one especially preferred embodiment where it has been discovered to be critical that the phosphate solution be nonboiling, the sealing solution is maintained at a temperature between 70° C. and about 95° C. Sealing involves expansion of the lattice of the deposited material such that it essentially grows together. The coating yielded is substantially continuous, i.e., the instance of cracking and other discontinuity is relatively low. Without being bound to a particular theory, it is believed that cerium phosphate compounds are formed.

One aspect of the invention consists of an electrochemically metallized (brush plating) cerium-based coating on aluminum and aluminum alloy structural components, which coating is of relatively uniform thickness, is blister-free, and strongly adherent to the component. The coating has a continuous surface area of at least about 4 in$^2$ and a thickness of at least about 0.1 microns, preferably about 0.1 to about 2.0 microns, and more preferably about 1.0 microns.

In this alternative deposition method that utilizes the invention, an aluminum containing component is pretreated by cleaning, and connected to an external power source to make it the cathodic electrode. The other connection is made to a mobile insoluble electrode (e.g. lead alloy or dimensionally stable anode), which has a contacting surface of 1 in$^2$, is surrounded by a polyester jacket or a similar material that serves as the brush and is soaked in a cerium-containing solution that serves as the electrolyte. The mobile anode is contacted to the aluminum or aluminum alloy surface to complete the circuit and initiate the deposition of a cerium compound.

The foregoing relates only to a limited number of embodiments that have been provided for illustration purposes only. It is intended that the scope of invention is defined by the appended claims and there are modifications of the above embodiments that do not depart from the scope of the invention.

What is claimed is:

1. A process for enhancing the corrosion resistance of an aluminum-based component comprising:

immersing the aluminum-based component as a cathode, and an oxygen-evolving anode, in an electrolyte comprising water, cerium ions, and an additive selected from the group consisting of animal gelatin, derivatives of animal gelatin, and amino acids; and passing an electrical current through the electrolyte to deposit a cerium-based coating onto the aluminum-based component.

2. The process of claim 1 wherein the additive selected from the group consisting of animal gelatin, derivatives of animal gelatin, and amino acids is selected from the group consisting of pigskin gelatin, proline, hydroxyproline, glycine, and arginine.

3. The process of claim 1 comprising:

passing the electrical current through the electrolyte to facilitate cathodic precipitation under conditions characterized by a current density of from about 1 mAmp/cm$^2$ to about 50 mAmps/cm$^2$ to thereby deposit the cerium-based coating onto the aluminum-based component, said coating having a thickness of at least about 0.1 microns.

4. The process of claim 3 wherein the pH of the electrolyte is at least about 1 and wherein the pH of the electrolyte is no greater than about 4.5.

5. The process of claim 4 wherein the pH of the electrolyte is at least about 1 and wherein the pH of the electrolyte is no greater than about 3.

6. The process of claim 5 wherein the pH of the electrolyte is at least about 2 and no greater than about 2.2.

7. The process of claim 5 wherein the electrolyte contains between about 1 vol % and about 20 vol % hydrogen peroxide.

8. The process of claim 7 wherein the electrolyte contains between about 1 vol % and about 10 vol % hydrogen peroxide.

9. The process of claim 7 wherein the electrolyte contains about 4 vol % hydrogen peroxide.

10. The process of claim 7 wherein the electrolyte has a cerium ion concentration of at least about 0.01 mole per liter and a cerium ion concentration of no more than about 1 mole per liter.

11. The process of claim 10 wherein the electrolyte has a cerium ion concentration of at least about 0.01 mole per liter and a cerium ion concentration of no more than about 0.05 mole per liter.

12. The process of claim 11 wherein the electrolyte has a cerium ion concentration of about 0.03 mole per liter.

13. The process of claim 1 wherein the additive selected from the group consisting of animal gelatin, derivatives of animal gelatin, and amino acids constitutes between about 0.01 wt % and about 1 wt % of the electrolyte.

14. The process of claim 13 wherein the additive selected from the group consisting of animal gelatin, derivatives of animal gelatin, and amino acids constitutes between about 0.1 wt % and about 0.5 wt % of the electrolyte.

15. The process of claim 14 wherein the additive selected from the group consisting of animal gelatin, derivatives of animal gelatin, and amino acids constitutes between about 0.25 wt % and about 0.35 wt % of the electrolyte.

16. The process of claim 14 comprising passing the electrical current through the electrolyte at a current density of at least about 5 mAmp/cm$^2$ and at a current density of no more than about 15 mAmps/cm$^2$.

17. The process of claim 16 comprising passing the electrical current through the electrolyte at a current density of at least about 8 mAmp/cm$^2$ and at a current density of no more than about 12 mAmps/cm$^2$.

18. The process of claim 17 comprising passing the electrical current through the electrolyte at a current density of about 10 mAmp/cm$^2$.

19. The process of claim 1 wherein the electrolyte consists essentially of said water, a cerium salt, an oxidizing agent, and the additive selected from among the group consisting of animal gelatin, derivatives of animal gelatin, and amino acids.

20. The process of claim 1 wherein the electrolyte is alcohol free.

21. The process of claim 1 comprising immersing the component in an alkaline cleaning solution prior to immersing in the electrolyte.

22. A process for enhancing the corrosion resistance of an aluminum-based component comprising:

immersing the aluminum-based component and an oxygen-evolving anode in an electrolyte comprising a source of cerium ions, water, hydrogen peroxide, and an additive selected from the group consisting of animal gelatin, derivatives of animal gelatin, and amino acids; and passing an electrical current through the electrolyte to facilitate cathodic precipitation under conditions characterized by a current density of at least about 1 mAmp/cm$^2$ and of no more than about 50 mAmps/cm$^2$ to deposit a cerium-based coating onto the aluminum-based component, said coating having a thickness of at least about 0.1 microns;

wherein the electrolyte has the following characteristics:

a pH of between about 1 and about 4.5;

a hydrogen peroxide concentration between about 1 vol % and about 20 vol %;

a cerium ion concentration between about 0.01 mole per liter and about 1 mole per liter;

a concentration of said additive selected from the group consisting of animal gelatin, derivatives of animal gelatin, and amino acids of between about 0.01 wt % and about 1 wt % of the electrolyte.

23. The process of claim 22 wherein the additive selected from the group consisting of animal gelatin, derivatives of animal gelatin, and amino acids is selected from the group consisting of pigskin gelatin, proline, hydroxyproline, glycine, and arginine.

24. The process of claim 23 wherein the electrolyte has the following characteristics:

said pH is between about 1 and about 3;

said hydrogen peroxide concentration is between about 1 vol % and about 4 vol %;

said cerium ion concentration is between about 0.01 mole per liter and about 0.3 mole per liter; and said concentration of additive selected from the group consisting of animal gelatin, derivatives of animal gelatin, and amino acids is between about 0.1 wt % and about 0.5 wt %.

25. The process of claim 23 wherein the electrolyte has the following characteristics:

said pH is between about 2 and about 2.2;

said hydrogen peroxide concentration is between about 1 vol % and about 1.6 vol %;

said cerium ion concentration is between about 0.01 mole per liter and about 0.05 mole per liter;

said concentration of additive selected from the group consisting of animal gelatin, derivatives of animal gelatin, and amino acids is between about 0.25 wt % and about 0.35 wt %.

26. The process of claim 22 comprising sealing the cerium-based coating by immersion in an elevated temperature phosphate solution.

27. The process of claim 26 wherein the elevated temperature phosphate solution is non-boiling and at a temperature between about 70° C. and about 95° C.

28. The process of claim 22 wherein the electrolyte consists essentially of said source of cerium ions, said water, said hydrogen peroxide, and said additive selected from the group consisting of animal gelatin, derivatives of animal gelatin, and amino acids.

29. The process of claim 22 wherein the electrolyte is alcohol free.

* * * * *